US007104837B1

(12) United States Patent
Huang

(10) Patent No.: US 7,104,837 B1
(45) Date of Patent: Sep. 12, 2006

(54) STRUCTURE OF A ROTATABLE USB FEMALE CONNECTOR

(75) Inventor: Chun-Jung Huang, Taipei (TW)

(73) Assignee: Inventec Corporation, Taipei (TW)

( * ) Notice: Subject to any disclaimer, the term of this patent is extended or adjusted under 35 U.S.C. 154(b) by 0 days.

(21) Appl. No.: 11/360,571

(22) Filed: Feb. 24, 2006

(51) Int. Cl.
*H01R 13/60* (2006.01)

(52) U.S. Cl. ..... 439/540.1; 439/954

(58) Field of Classification Search ..... 439/76.1, 439/171, 173, 540.1, 534, 660, 946, 954
See application file for complete search history.

(56) References Cited

U.S. PATENT DOCUMENTS 5,928,009 A * 7/1999 Lee ..... 439/131
6,676,420 B1 * 1/2004 Liu et al. ..... 439/131
6,786,734 B1 * 9/2004 Yu ..... 439/11
6,893,267 B1 * 5/2005 Yueh ..... 439/8
2004/0105329 A1 * 6/2004 Lin et al. ..... 365/202
2004/0229478 A1 * 11/2004 Chen ..... 439/11

* cited by examiner

*Primary Examiner*—Thanh-Tam Le
(74) *Attorney, Agent, or Firm*—Rabin & Berdo, P.C.

(57) ABSTRACT

A rotatable USB female connector is used inside the computer case to connect with a USB male connector. Since the female connector is rotatable, it can be connected to electronic devices with various kinds of USB male connectors. The structure includes a support base, a shaft sheath, and a USB female connector. The support base is fixed on one side of the computer case. The shaft sheath is pivotally installed in the support base and rotatable with respect to the support base. The USB female connector is disposed in the shaft sheath to be connected with a USB male connector for data transmissions.

6 Claims, 6 Drawing Sheets

STRUCTURE OF A ROTATABLE USB FEMALE CONNECTOR

BACKGROUND OF THE INVENTION

1. Field of Invention

The invention relates to the structure of a USB female connector and, in particular, to the structure of a rotatable USB female connector.

2. Related Art

Advances in computer technology have made human life much easier. Many computer-related products, such as electronic dictionaries, digital cameras, mobile phones with cameras, and card readers, are very popular in daily life. Due to their limitation in storage capacity, they are often connected to a computer for data transfer between the products and the computer. These data transfers are usually done via USB, infrared, Bluetooth, or network means.

Universal serial bus (USB) is a data transmission standard set by IBM, Intel, Microsoft, NEC, Compaq, DEC, and Northern Telecom for connections between devices with USB connectors, such as pen drives, removable hard drives, digital cameras, mice, keyboards, scanners, and printers. The USB interface has many advantages, such as high speeds, easy connections, plug-and-play (PnP) possible, no need for any external power, supporting many devices, and highly compatible. Therefore, the USB has become a standard port on personal computers.

For the convenience of carrying data, a portable removable disk, called the pen drive, with a smaller volume but larger storage capacity is invented. This kind of pen drives is not portable and small in size, and has the USB interface. It can be plugged and played without any self-supplying power source. It can be used as a means for transmissions between a computer and computer-related products. Since, the pen drive has the characteristics of high transmission speeds and stability, the user therefore does not need to carry a large-volume electronic device. Due to its large memory space, it can be conveniently used as a storage device. In comparison with the conventional hard disk drive, the pen drive is stronger in structure and less fragile. Therefore, using the pen drive as a means for data storage and transmissions can reduce the risk of loss or damages.

Since almost all the current electronic products use the USB as the interface with the computer, the computer mainframe is often equipped with USB female connectors. An example of the conventional USB female connector is shown in FIG. 1A. In general, the notebook case 10 is usually provided with a USB female connector 60 for computer-related products, such as the pen drive 72 to connect. After a USB male connector 70 is plugged into the USB female connector 60, data can be transmitted. In order to win more consumers, the manufacturers often change the appearance of the pen drive 72. Although this can attract some consumers, thick pen drives 72 are likely to encounter some problem in use. Suppose the height from the lower edge of the USB make connector 70 to the lower edge of the case of the pen drive 72 is H and the height from the lower edge of the USB female connector 60 to the lower edge of the computer case 10 is h. If H is greater than h, then when the pen drive 72 is plugged into the USB female connector 60 on the notebook computer case 10, the computer case 10 is pushed up, resulting in inconvenience in use.

Please refer to FIG. 1B for an application of the conventional USB female connector. Some notebook computers have two USB female connectors 60. Since the notebook computers are designed to be more compact, the two USB female connectors 60 are often disposed very close to each other in order to save space. In this case, as one pen drive 72 is inserted into one of the USB female connector 60, only the other USB female connector 60 is left for another pen drive 74. If the widths of the two pen drives 72, 74 are too large, then the second pen drive 74 cannot be inserted into the USB female connector 60, as shown in the drawing. It is thus meaningless to have two USB female connectors 60 on the notebook computer.

The conventional pen drive or card reader with the USB interface is not provided with a rotatable USB male connector. R.O.C. Pat. No. M249179 discloses a portable storage device with a rotatable connector. The device includes a case whose front end is formed with a hole and an electrically connected rotator disposed inside the case hole, the electrically connected rotator using two relatively rotating connecting pieces to transmit electrical signals; an electronic storage device disposed inside the case, the electronic storage device being electrically coupled to one of the connecting pieces of the electrically connected rotator; an electrical connector disposed on the connecting piece opposite to the electrically connector rotator so that the electrical connector and the electronic storage device exchange electrical signals via the electrically connector rotator. This enables the electrical connector to rotate. The design of a rotatable USB male connector is for the convenience of inserting the device into a computer or other related peripheral equipment with a USB female connector. However, the electronic device with a rotatable USB male connector is more expensive. Even though there are other more compact pen drives on the market, it is impractical for users who already have pen drives with larger sizes to purchase compact pen drives simply for fitting the USB female connectors. If the orientation of the USB female connector can be changed, the development of pen drives will be greatly advanced and the users will be less restricted by the inconvenience.

SUMMARY OF THE INVENTION

In view of the foregoing, an objective of the invention is to provide a rotatable USB female connector to overcome existing problems or drawbacks in the prior art.

The structure of the disclosed rotatable USB female connector is designed to connect with the USB male connector on one side of a computer case for data transmissions. The disclosed female connector has a rotatable design so that when a user plugs in a male connector, he or she can rotate the female connector to solve various problems due to the volume of the electronic device with the USB male connector. Its structure mainly includes a support base, a shaft sheath, and a USB female connector.

One side of the computer case is provided with a support base with an annular structure. There is a first protruding block on the support base extending towards the radial center. The annular support base covers a shaft sheath with a hollow cylinder shape and a diameter smaller than the diameter of the support base. There is a second protruding block on the shaft sheath extending outward in the radial direction. The shaft sheath is provided with a USB female connector to connect to a USB male connector for receiving data therefrom. The other end of the USB female connector is connected to a conducting wire whose other end is connected to the circuit board of the computer. When the shaft sheath rotates clockwise or counterclockwise with respect to the support base and reaches a specific angle, the first protruding block on the support base and the second protruding block on the shaft sheath touch each other, limiting the largest angle that the shaft sheath can rotate. The restricting angle can be smaller than 360 degrees, so that the conducting wire does not break due to an unlimited rotation. Also, the length of the conducting wire has to be sufficient for the shaft sheath to make the largest-angle rotation.

This rotatable design of the USB female connector can solve the problem of a connection with a USB male connector of an electronic product with a large shape. There is therefore no restriction in the appearance of the electronic device with the USB male connector. One also does not need to purchase particularly those electronic products with compact USB male connectors.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 1A:
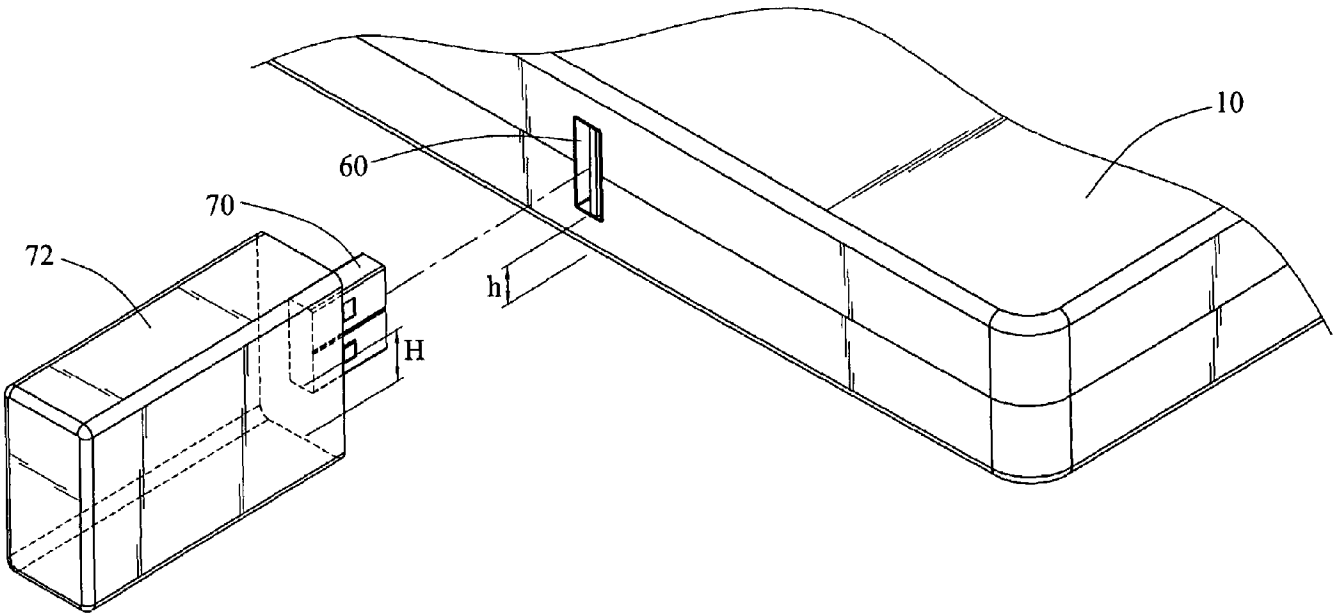
FIG.1A (PRIOR ART)
FIG. 1A is a schematic view of an application of the conventional USB female connector.
Figure 1B:
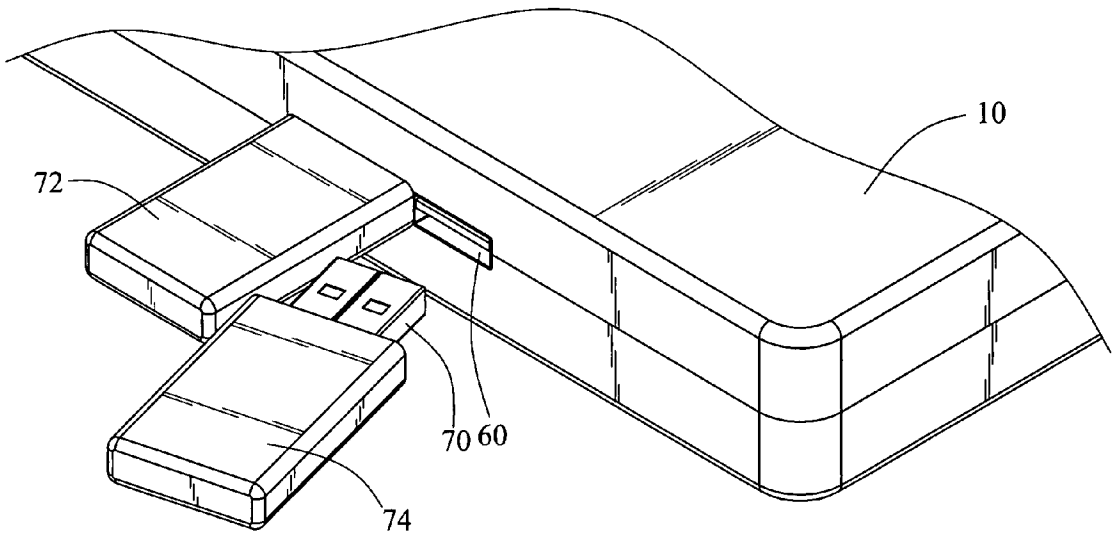
FIG.1B (PRIOR ART)
FIG. 1B is a schematic view of an application of the conventional USB female connector.
Figure 2A:
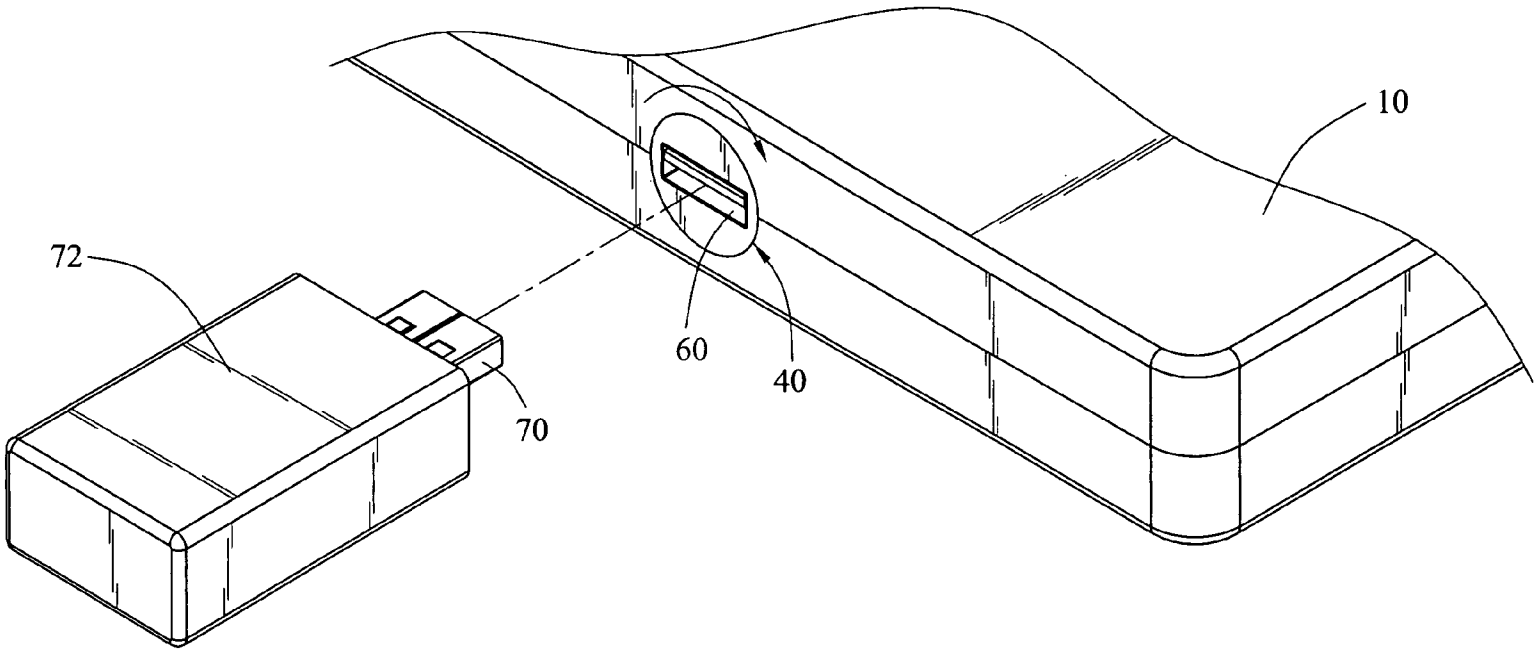
FIG. 2A is a schematic view of an application of the disclosed rotatable USB female connector.

The structure of the rotatable USB female connector in accord with the invention is shown in FIG. 2A. As illustrated in the drawing, the USB female connector 60 can rotate with respect to the case 10 to an arbitrary angle. This solves the above-mentioned problem that the notebook computer case 10 is pushed up due to the thickness of the pen drive 72.

Figure 2B:
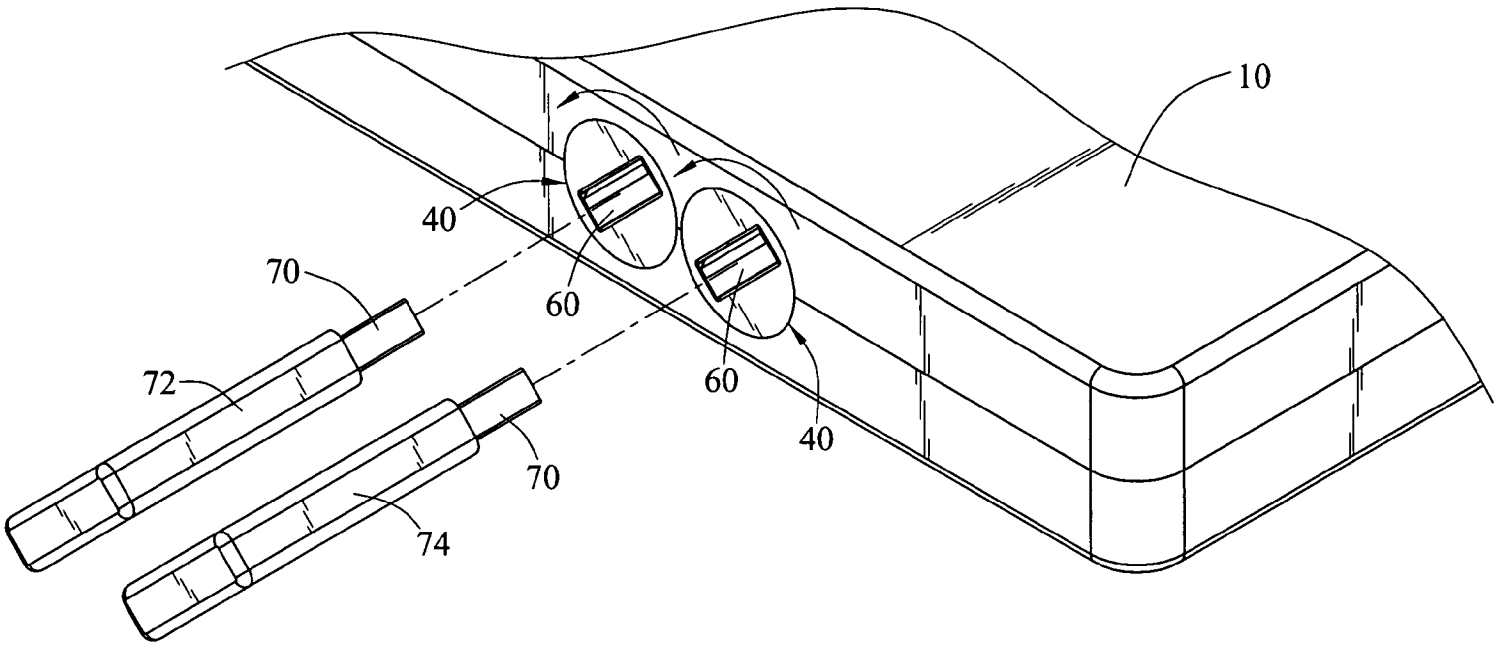
FIG. 2B is a schematic view of an application of the disclosed rotatable USB female connector.

The disclosed rotatable USB female connector can also solve the problem that two pen drives 72, 74 cannot be simultaneously inserted due to their widths. FIG. 2B shows an application of the disclosed rotatable USB female connector. When two USB female connectors 60 rotate an angle with respect to the case 10, the two pen drives 72, 74 can be inserted into the two USB female connectors 60 simultaneously without interfering with each other.

Figure 3:
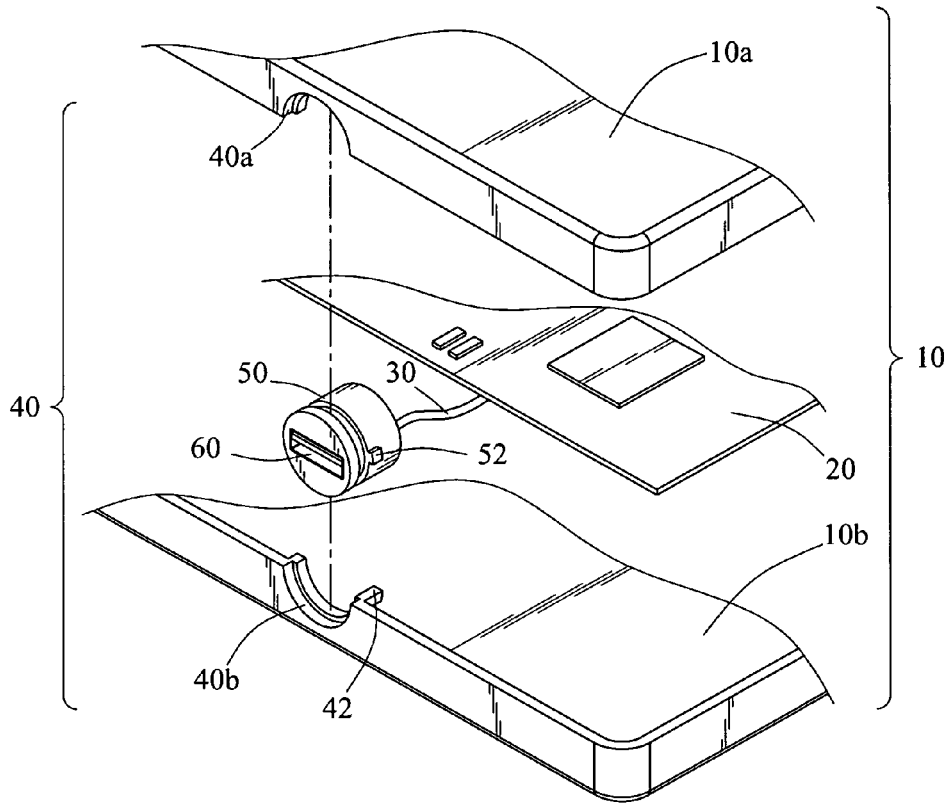
FIG. 3 is an exploded view of the structure of the disclosed rotatable USB female connector.

With reference to FIG. 3, the case 10 includes an upper case 10*a* and a lower case 10*b*. The upper case 10*a* is disposed with an upper portion of the support base 40*a*, and the lower case 10*b* is disclosed with a lower portion of the support base 40*b*. The upper portion 40*a* and the lower portion 40*b* of the support base are combined to form the support base 40. As the diameter of the shaft sheath 50 is smaller than the inner diameter of the support base 40, the shaft sheath 50 can be disposed inside the support base 40 and rotate therein. Even though the support base 40 shown in the drawing has an annular structure, it can be made to have a hollow cylindrical structure that can accommodate the shaft sheath 50. Afterwards, the hollow cylindrical shaft sheath 50 is disposed with a USB female connector 60 to connect with the USB male connector 70 for receiving data therefrom. The USB female connector 60 and the circuit board 20 are connected by a conducting wire 30 for transmitting data from the USB male connector 70 to the circuit board 20. The length of the conducting wire 30 has to be sufficient for the shaft sheath 50 to rotate to its largest angle.

Figure 4A:
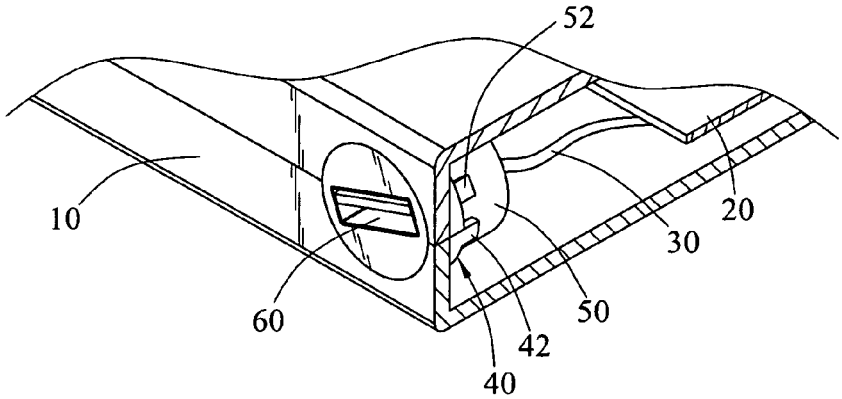
FIG. 4A is a schematic view of the invention before the first protruding block and the second protruding block touch each other.
Figure 4B:
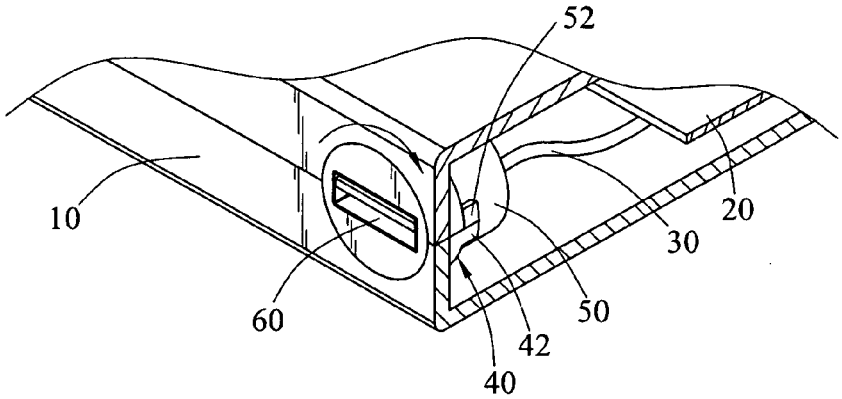
FIG. 4B is a schematic view of the invention after the first protruding block and the second protruding block touch each other.

FIG. 4A is a schematic view showing the invention before the first protruding block and the second protruding block touch each other. A first protruding block 42 is formed on the lower portion of the support base 40*b*, extending radially toward the center. A second protruding block 52 is formed on the shaft sheath 50, extending radially outward. When the shaft sheath 50 rotates clockwise or counterclockwise with respect to the support base 40 and reaches a specific angle, the first protruding block 42 on the support base 40 and the second protruding block 52 on the shaft sheath 50 touch each other, restricting the largest angle that the shaft sheath 50 can rotate. The restricting angle of the shaft sheath 50 can be smaller than 360 degrees, so that the conducting wire does not break due to an unlimited rotation. FIG. 4B is a schematic view showing the invention after the first protruding block and the second protruding block touch each other.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A rotatable Universal Serial Bus (USB) female connector to be installed in a computer case for the connection with a USB male connector, the computer having a circuit board and communicating data with the USB male connector, the rotatable USB female connector comprising:

a support base, which is disposed in the computer case and has a first protruding block extending radially toward the center;

a shaft sheath, which is pivotally disposed in the support base, and has a second protruding block extending radially outward, so that when the shaft sheath rotates with respect to the support base the first protruding block and the second protruding block touch each other to restrict the rotation angle of the shaft sheath to be smaller than 360 degrees;

a USB female connector, which is disposed in the shaft sheath to be connected with the USB male connector for receiving data therefrom; and a conducting wire, which connects the USB female connector and the circuit board and, when the USB female connector and the USB male connector are connected, transfers data from the USB male connector to the circuit board.

2. The rotatable USB female connector of claim 1, wherein the support base has an annular shape.

3. The rotatable USB female connector of claim 1, wherein the shaft sheath is a hollow cylinder.

4. The rotatable USB female connector of claim 1, wherein the diameter of the shaft sheath is smaller than the inner diameter of the support base.

5. The rotatable USB female connector of claim 1, wherein the shaft sheath rotates clockwise and counterclockwise.

6. The rotatable USB female connector of claim 1, wherein the length of the conducting wire is greater than the length needed for the shaft sheath to make a rotation.

* * * * *